US006632486B1

(12) United States Patent
Sadasivan et al.

(10) Patent No.: US 6,632,486 B1
(45) **Date of Patent: *Oct. 14, 2003**

(54) INK JET RECORDING ELEMENT

(75) Inventors: Sridhar Sadasivan, Rochester, NY (US); Suresh Sunderrajan, Rochester, NY (US); Michelle M. Oakland, Macedon, NY (US); Patrick J. Whittaker, Webster, NY (US); Elwood C. Samons, Holley, NY (US); Craig T. Mollon, Batavia, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/451,786

(22) Filed: Dec. 1, 1999

(51) Int. Cl.[7] ..... B41M 5/00

(52) U.S. Cl. ..... 428/32.15; 428/32.3; 428/32.29; 428/32.34

(58) Field of Search ..... 428/195, 330, 428/331, 329, 500, 32.15, 32.3, 32.29, 32.34

(56) References Cited

U.S. PATENT DOCUMENTS

| | | | | |
|---|---|---|---|---|
| 3,958,995 | A | * | 5/1976 | Campbell et al. |
| 5,478,631 | A | * | 12/1995 | Kawano et al. |
| 5,498,505 | A | * | 3/1996 | Tsukahara et al. |
| 5,851,651 | A | | 12/1998 | Chao |
| 5,919,558 | A | * | 7/1999 | Chao |
| 6,001,482 | A | * | 12/1999 | Anderson |
| 6,165,593 | A | * | 12/2000 | Brault et al. |

FOREIGN PATENT DOCUMENTS

| | | | |
|---|---|---|---|
| DE | 43 30 428 A1 | | 3/1994 |
| DE | 195 34 327 A1 | | 2/1996 |
| EP | 0 869 010 A1 | | 10/1998 |
| EP | 869010 | * | 10/1998 |
| FR | 72.30370 | | 4/1973 |

* cited by examiner

*Primary Examiner*—Pamela R. Schwartz
(74) *Attorney, Agent, or Firm*—Harold E. Cole

(57) ABSTRACT

An ink jet recording element comprising a substrate having thereon an image-receiving layer comprising an inorganic, anionic pigment, an organic, anionic binder and an organic, cationic mordant.

7 Claims, No Drawings

INK JET RECORDING ELEMENT

CROSS REFERENCE TO RELATED APPLICATIONS

Reference is made to commonly assigned, co-pending U.S. patent application Serial Numbers:

Ser. No. 09/451,809 by Sadasivan et al., filed Dec. 1, 1999, entitled "Method of Preparing a Stable Coating" now U.S. Pat. No. 6,335,395;

Ser. No. 09/452,595 by Sunderrajan et al., filed Dec. 1, 1999, entitled "Glossy Ink Jet Recording Element";

Ser. No. 09/452,396 by Sadasivan et al., filed Dec. 1, 1999, entitled "Ink Jet Printing Method"; and Ser. No. 09/452,822 by Sunderrajan et al., filed Dec. 1, 1999, entitled "Ink Jet Printing Method" now U.S. Pat. No. 6,347,866.

FIELD OF THE INVENTION

This invention relates to an ink jet recording element. More particularly, this invention relates to an ink jet recording element containing pigments.

BACKGROUND OF THE INVENTION

In a typical ink jet recording or printing system, ink droplets are ejected from a nozzle at high speed towards a recording element or medium to produce an image on the medium. The ink droplets, or recording liquid, generally comprise a recording agent, such as a dye or pigment, and a large amount of solvent. The solvent, or carrier liquid, typically is made up of water, an organic material such as a monohydric alcohol, a polyhydric alcohol or mixtures thereof.

An ink jet recording element typically comprises a support having on at least one surface thereof an ink-receiving or image-forming layer, and includes those intended for reflection viewing, which have an opaque support, and those intended for viewing by transmitted light, which have a transparent support.

While a wide variety of different types of image-recording elements for use with ink jet devices have been proposed heretofore, there are many unsolved problems in the art and many deficiencies in the known products which have limited their commercial usefulness.

It is well known that in order to achieve and maintain photographic-quality images on such an image-recording element, an ink jet recording element must:

- Be readily wetted so there is no puddling, i.e., coalescence of adjacent ink dots, which leads to nonuniform density
- Exhibit no image bleeding
- Exhibit the ability to absorb high concentrations of ink and dry quickly to avoid elements blocking together when stacked against subsequent prints or other surfaces
- Exhibit no discontinuities or defects due to interactions between the support and/or layer(s), such as cracking, repellencies, comb lines and the like
- Not allow unabsorbed dyes to aggregate at the free surface causing dye crystallization, which results in bloom or bronzing effects in the imaged areas
- Have an optimized image fastness to avoid fade from contact with water or radiation by daylight, tungsten light, or fluorescent light An ink jet recording element that simultaneously provides an almost instantaneous ink dry time and good image quality is desirable. However, given the wide range of ink compositions and ink volumes that a recording element needs to accommodate, these requirements of ink jet recording media are difficult to achieve simultaneously.

Ink jet recording elements are known that employ porous or non-porous single layer or multilayer coatings that act as suitable image receiving layers on one or both sides of a porous or non-porous support. Recording elements that use non-porous coatings typically have good image quality but exhibit poor ink dry time. Recording elements that use porous coatings typically have poorer image quality but exhibit superior dry times.

U.S. Pat. No. 5,851,651 relates to an ink jet recording element comprising a paper substrate with a coating comprising inorganic pigments and an anionic, organic co-binder system. The co-binder system consists of polyvinyl alcohol (PVOH) and polyvinylpyrrolidone (PVP) or a copolymer of polyvinylpyrrolidone-vinyl acetate (PVP-VA). However, there is a problem with this element in that less than desirable image quality, as measured by optical density, image bleed, and waterfastness, is obtained German Patent DE 19,534,327A1 relates to an ink jet recording element which contains a recording layer comprising an inorganic, cationic pigment and a cationic organic binder. However, this recording layer also has less than desirable image quality, as measured by optical density, image bleed, and waterfastness.

It is an object of this invention to provide an ink jet recording element that has a fast ink dry time. It is another object of this invention to provide an ink jet recording element that has good image quality.

SUMMARY OF THE INVENTION

These and other objects are achieved in accordance with the invention which comprises an ink jet recording element comprising a substrate having thereon an image-receiving layer comprising an inorganic, anionic pigment, an organic, anionic binder and an organic, cationic mordant.

The ink jet recording element of the invention provides good image quality and fast ink dry times.

DETAILED DESCRIPTION OF THE INVENTION

The inorganic, anionic pigment useful in the invention may be a kaolin clay, a calcined clay, titanium dioxide, talc or a silicate. In a preferred embodiment of the invention, the inorganic, anionic pigment is a kaolin clay sold under the trade name Hydragloss® 92 (J. M. Huber Company). The amount of inorganic, anionic pigment used may range from about 50% to about 95% of the image-receiving layer.

The organic, anionic binder useful in the invention may be a styrene acrylic latex, a styrene butadiene latex, a poly (vinyl alcohol) or a poly(vinyl acetate). A commercially-available styrene acrylic latex useful in the invention is Acronal® S-728 (BASF Corp.). A commercially-available styrene butadiene latex useful in the invention is Styronal® BN 4606X (BASF Corp.). A commercially-available poly (vinyl alcohol) useful in the invention is Airvol® 21-205 (Air Products Inc.). A commercially-available poly(vinyl acetate) useful in the invention is Vinac® 884 (Air Products Inc.).

The organic, anionic binder may be used in an amount of from about 5% to about 20% of the image-receiving layer. In general, good results are obtained when the ratio of pigment to binder is from about 5:1 to about 8:1.

The organic, cationic mordant useful in the invention may be a polymer latex dispersion or a water-soluble polymer solution. Examples of mordants useful in the invention are disclosed in U.S. Pat. No. 5,474,843. Other useful mordants include cationic urethane dispersions sold under the trade name Witcobond® W-213 and Witcobond® W-215 (Witco Corporation).

In a preferred embodiment of the invention, the organic, cationic mordant is:

M1: poly(N-vinyl benzyl-N-benzyl-N,N-dimethyl ammonium chloride-co-styrene-co-divinyl benzene), M2: poly(N-vinylbenzyl-N,N,N-trimethylammonium chloride-co-ethylene glycol dimethacrylate), or M3: poly(N-vinylbenzyl-N,N,N-trimethylammonium chloride-co-divinyl benzene).

In general, good results have been obtained when the mordant polymer is present in an amount of from about 1% to about 75% by weight of the image-receiving layer, preferably from about 10% to about 20%.

Smaller quantities of up to about 10% of other binders may also be added to the image-receiving layer such as PVP sold as Luviskol® VA 64W (BASF Corp.) or copolymer PVP-VA sold as Luviquat® PQ11PN (BASF Corp.). In addition to the above major components, other additives such as pH-modifiers like nitric acid, cross-linkers, rheology modifiers, surfactants, UV-absorbers, biocides, lubricants, dyes, optical brighteners etc. may be added as needed.

The substrate may be porous such as paper or non-porous such as cellulose acetate or polyester films. The surface of the substrate may be treated in order to improve the adhesion of the image-receiving layer to the support. For example, the surface may be corona discharge treated prior to applying the image-receiving layer to the support. Alternatively, an under-coating or subbing layer, such as a layer formed from a halogenated phenol or a partially hydrolyzed vinyl chloride-vinyl acetate copolymer, can be applied to the surface of the support.

The ink jet coating may be applied to one or both substrate surfaces through conventional pre-metered or post-metered coating methods such as blade, air knife, rod, roll coating, etc. The choice of coating process would be determined from the economics of the operation and in turn, would determine the formulation specifications such as coating solids, coating viscosity, and coating speed. In a preferred embodiment, the coating formulation would have a coating solids of 40–60% and a low shear (100 rpm Brookfield) viscosity of 500–2000 centiPoise.

The image-receiving layer thickness may range from about 5 to about 60 $\mu$m, preferably from about 20 to about 40 $\mu$m. The coating thickness required is determined through the need for the coating to act as a sump for absorption of ink solvent and the need to hold the ink near the coating surface. The coating may be applied in a single layer or in multiple layers so the functionality of each coating layer may be specified; for example, a two-layer structure can be created wherein the base coat functions as a sump for absorption of ink solvent while the top coat holds the ink.

After coating, the ink jet recording element may be subject to calendering or supercalendering to enhance surface smoothness. In a preferred embodiment of the invention, the ink jet recording element is subject to hot, soft-nip calendering at a temperature of about 65° C. and pressure of 14000 kg/m at a speed of from about 0.15 m/s to about 0.3 m/s.

The substrate used in the ink jet recording element of the invention may be opaque, translucent, or transparent. There may be used, for example, plain papers, resin-coated papers, various plastics including a polyester resin such as poly (ethylene terephthalate), poly(ethylene naphthalate) and poly(ester diacetate), a polycarbonate resin, a fluorine resin such as poly(tetra-fluoro ethylene), metal foil, various glass materials, and the like. The thickness of the substrate employed in the invention can be from about 12 to about 500 $\mu$m, preferably from about 75 to about 300 $\mu$m.

Ink jet inks used to image the recording elements of the present invention are well-known in the art. The ink compositions used in ink jet printing typically are liquid compositions comprising a solvent or carrier liquid, dyes or pigments, humectants, organic solvents, detergents, thickeners, preservatives, and the like. The solvent or carrier liquid can be solely water or can be water mixed with other water-miscible solvents such as polyhydric alcohols. Inks in which organic materials such as polyhydric alcohols are the predominant carrier or solvent liquid may also be used. Particularly useful are mixed solvents of water and polyhydric alcohols. The dyes used in such compositions are typically water-soluble direct or acid type dyes. Such liquid compositions have been described extensively in the prior art including, for example, U.S. Pat. Nos. 4,381,946; 4,239,543 and 4,781,758, the disclosures of which are hereby incorporated by reference.

Although the recording elements disclosed herein have been referred to primarily as being useful for ink jet printers, they also can be used as recording media for pen plotter assemblies. Pen plotters operate by writing directly on the surface of a recording medium using a pen consisting of a bundle of capillary tubes in contact with an ink reservoir.

The following examples further illustrate the invention.

EXAMPLES

Example 1

Coating formulations were prepared as follows (in dry grams):

| Constituent | Control Coating 1 | Control Coating 2 | Coating 1 of the Invention |
|---|---|---|---|
| Kaolin clay (Hydragloss ® 92) as a dry powder | 100 | 100 | 100 |
| Mordant M3 as a 15% solids dispersion | — | — | 30 |
| PVP (Luviskol ® 64W) as a 50% solids solution | — | 10 | — |
| Styrene acrylic latex (Acronal ® S728) as a 50% solids dispersion | 10 | 10 | 10 |
| Nitric Acid (1N) | — | — | 1.0 |

The above kaolin clay and styrene acrylic latex are both predominantly anionic. The mordant polymer M3 is cationic. The coating formulation thus comprises a mixture of anionic and cationic materials. To achieve a stable formulation, it is necessary to minimize the anionic charge keeping the cationic charge constant. This is achieved by adjusting the pH of the kaolin clay and styrene acrylic latex using nitric acid.

In addition, in order to achieve a stable formulation, the kaolin clay and styrene acrylic latex are added to the cationic Mordant M3 and then the pH is adjusted. Further details of this method are found in copending U.S. patent application Ser. No. 09/451,809 by Sadasivan et al., filed Dec. 1, 1999, entitled "Method of Preparing a Stable Coating", U.S. Pat. No. 6,335,395.

Each coating was applied onto a paper base using a wire wound Meyer rod of wire diameter 0.51 $\mu$m with a wet laydown thickness of 40 $\mu$m to form Control Elements 1 and 2 and Element 1 of the Invention. The base paper used was Nekoosa Solutions Smooth® (Georgia Pacific Co.), Grade 5128 (Carrara White®, Color 9220), basis weight 150 g/m$^2$. After application, the elements were air-dried. The Element 1 of the Invention was then subjected to hot, soft-nip calendering at a temperature of 65° C. and pressure of 14,000 kg/m at a speed of 0.3 m/s.

Samples from each of the elements above were printed on a Hewlett Packard Photosmart® printer with printer settings at "photoglossy paper, best" and subsequently tested for dry time and optical density of the composite black stripe. The inks used were Hewlett Packard Photosmart® inks.

Dry time, defined as the time after printing at which no ink retransfer from the printed element to a blotting sheet is observed, was measured using a blotting technique. One sample per element was subjected to the dry time test. A striped target was printed comprising 100% coverage of yellow, cyan, and magenta, 200% coverage for red, green, and blue, and 300% coverage for black in areas of 1 cm by 23 cm. Immediately after printing was finished, the sample was placed on a foam base, a piece of copy paper placed on top of the sample, and a weighted smooth rod was rolled over the paper. The copy sheet was then taken off the sample and studied for retransfer. The results in Table 1 are given as ratings from 1–5, where 1 corresponds to no transfer (fast dry time) to the copy paper, while 5 corresponds to complete transfer (the whole stripe is visible on the copy paper).

Optical density of the printed recording elements was measured using a X-Rite® model 820 transmission/reflection densitometer with status A filtration. The black stripe on the target was tested. The results are the average of three measurements.

The following results were obtained:

TABLE 1

| Element | Dry time | Optical Density (Composite Black) |
|---|---|---|
| Control 1 | 1 | 0.91 |
| Control 2 | 1 | 1.05 |
| Invention 1 | 1 | 1.61 |

The above results show that element 1 of the invention had a higher optical density as compared to the control elements while maintaining a fast dry time.

Example 2

Waterfastness, defined as the loss in image optical density after prolonged submersion in water, was measured using a soak test. The ink jet recording elements of Example 1 were soaked in distilled water for five minutes with mild agitation. The elements were then allowed to dry on a bench-top overnight. The optical density was measured before and after immersion and the % change in density of each color stripe was recorded. The following results were obtained:

TABLE 2

| | Waterfastness | | | |
|---|---|---|---|---|
| Element | % Change in Cyan Density | % Change in Magenta Density | % Change in Yellow Density | % Change in Black Density |
| Control 1 | −65 | −55 | −68 | −58 |
| Control 2 | −58 | −47 | −62 | −51 |
| Invention 1 | −3 | 2 | 3 | −10 |

The above results show that the element of the invention had much less loss of optical density as compared to the control elements, thus indicating better waterfastness.

This invention has been described with particular reference to preferred embodiments thereof but it will be understood that modifications can be made within the spirit and scope of the invention.

What is claimed is:

1. An ink jet recording element comprising a substrate having thereon an image-receiving layer consisting essentially of an inorganic, anionic pigment, an organic, anionic binder and an organic, cationic mordant;

said inorganic, anionic pigment being present in an amount of from about 50% to about 95 weight % of said image-receiving layer;

said organic, anionic binder being present in an amount of from about 5% to about 20 weight % of said image-receiving layer; and said organic, cationic mordant being a polymer latex dispersion which is present in an amount of from about 1% to about 45 weight % of said image-receiving layer.

2. The recording element of claim 1 wherein said inorganic, anionic pigment is a kaolin clay, a calcined clay, titanium dioxide, talc or a silicate.

3. The recording element of claim 1 wherein said inorganic, anionic pigment is a kaolin clay.

4. The recording element of claim 1 wherein said organic, anionic binder is a styrene acrylic latex, a styrene butadiene latex, a poly(vinyl alcohol), or a poly(vinyl acetate).

5. The recording element of claim 1 wherein said organic, anionic binder is a styrene acrylic latex.

6. The recording element of claim 1 wherein said organic, cationic mordant is poly(N-vinyl benzyl-N-benzyl-N,N-dimethyl ammonium chloride-co-styrene-co-divinyl benzene); poly(N-vinylbenzyl-N,N,N-trimethylammonium chloride-co-ethylene glycol dimethacrylate); or poly(N-vinylbenzyl-N,N,N-trimethylammonium chloride-co-divinyl benzene).

7. The recording element of claim 1 wherein said organic, cationic mordant is poly(N-vinylbenzyl-N,N,N-trimethylammonium chloride-co-divinyl benzene).

* * * * *